US009281113B2

(12) United States Patent
Naito et al.

(10) Patent No.: US 9,281,113 B2
(45) Date of Patent: Mar. 8, 2016

(54) LAMINATED COIL COMPONENT, AND METHOD OF MANUFACTURING THE LAMINATED COIL COMPONENT

(71) Applicant: MURATA MANUFACTURING CO., LTD., Kyoto (JP)

(72) Inventors: Osamu Naito, Kyoto (JP); Hiroki Kowada, Kyoto (JP); Atsushi Yamamoto, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 47 days.

(21) Appl. No.: 14/105,079

(22) Filed: Dec. 12, 2013

(65) Prior Publication Data

US 2014/0097923 A1 Apr. 10, 2014

Related U.S. Application Data

(63) Continuation of application No. PCT/JP2012/065134, filed on Jun. 13, 2012.

(30) Foreign Application Priority Data

Jun. 15, 2011 (JP) ..... 2011-133090

(51) Int. Cl.
*H01F 27/02* (2006.01)
*H01F 5/00* (2006.01)
(Continued)

(52) U.S. Cl.
CPC ..... *H01F 17/043* (2013.01); *H01F 17/0033* (2013.01); *H01F 41/0246* (2013.01); *Y10T 29/49078* (2015.01)

(58) Field of Classification Search
CPC ... H01F 17/045; H01F 27/292; H01F 17/043; H01F 17/04
USPC ..... 336/83, 200, 233, 234
See application file for complete search history.

(56) References Cited

U.S. PATENT DOCUMENTS 3,798,059 A 3/1974 Astle et al.
5,304,318 A 4/1994 Watanabe et al.
(Continued)

FOREIGN PATENT DOCUMENTS

EP 1220591 A2 7/2002
EP 1983531 A1 10/2008
(Continued)

OTHER PUBLICATIONS

International Search Report; PCT/JP2012/065134; Sep. 4, 2012.
(Continued)

*Primary Examiner* — Elvin G Enad
*Assistant Examiner* — Kazi Hossain
(74) *Attorney, Agent, or Firm* — Studebaker & Brackett PC

(57) ABSTRACT

A laminated coil component includes a magnetic body part made of a ferrite material and a coil conductor wound into a coil shape and embedded in the magnetic body part to form a component base. The component base is divided into a first region near the coil conductor and a second region other than the first region. The grain size ratio of the average crystal grain size of the magnetic body part in the first region to the average crystal grain size of the magnetic body part in the second region is 0.9 or less. The molar content of CuO in the ferrite raw material is set to 0.2 to 4 mol %. In a method laminated coil component, the coil is formed from a conductive paste including Ag, and firing the laminated body is performed by setting the oxygen concentration is 0.1 volume % or less as a firing atmosphere.

10 Claims, 5 Drawing Sheets

(51) Int. Cl.

| | |
|---|---|
| ***H01F 27/24*** | (2006.01) |
| ***H01F 17/04*** | (2006.01) |
| ***H01F 17/00*** | (2006.01) |
| *H01F 41/02* | (2006.01) |

(56) References Cited

U.S. PATENT DOCUMENTS

| | | | | |
|---|---|---|---|---|
| 6,459,351 | B1 * | 10/2002 | Maki et al. | 336/200 |
| 2001/0024739 | A1 * | 9/2001 | Mizoguchi et al. | 428/692 |
| 2001/0025944 | A1 | 10/2001 | Kobayashi et al. | |
| 2002/0086145 | A1 | 7/2002 | Yazaki et al. | |
| 2004/0052932 | A1 | 3/2004 | Yazaki et al. | |
| 2004/0084131 | A1 | 5/2004 | Konoue et al. | |
| 2005/0199852 | A1 | 9/2005 | Takenoshita | |
| 2008/0102302 | A1 * | 5/2008 | Hirose et al. | 428/546 |
| 2009/0021337 | A1 * | 1/2009 | Sato | 336/234 |
| 2009/0045905 | A1 * | 2/2009 | Nakagawa et al. | 336/232 |
| 2009/0051476 | A1 | 2/2009 | Tada et al. | |
| 2009/0184794 | A1 * | 7/2009 | Tsuzuki | 336/200 |
| 2009/0231077 | A1 | 9/2009 | Liao et al. | |
| 2010/0085140 | A1 | 4/2010 | Tanaka et al. | |
| 2010/0194511 | A1 | 8/2010 | Kobayashi et al. | |
| 2010/0201473 | A1 | 8/2010 | Konoue et al. | |
| 2010/0283447 | A1 | 11/2010 | Tachibana et al. | |
| 2010/0289609 | A1 * | 11/2010 | Liao et al. | 336/221 |
| 2010/0308949 | A1 | 12/2010 | Lim et al. | |
| 2011/0102124 | A1 | 5/2011 | Matsushita | |
| 2011/0128109 | A1 | 6/2011 | Tada et al. | |
| 2011/0133881 | A1 * | 6/2011 | Nakajima et al. | 336/200 |
| 2011/0285486 | A1 * | 11/2011 | Maeda et al. | 335/297 |
| 2012/0105188 | A1 | 5/2012 | Lim et al. | |
| 2014/0047704 | A1 | 2/2014 | Lim et al. | |

FOREIGN PATENT DOCUMENTS

| | | | |
|---|---|---|---|
| EP | 2141137 | A1 | 1/2010 |
| JP | S63-102215 | A | 5/1988 |
| JP | H01-198003 | A | 8/1989 |
| JP | 02-260405 | A | 10/1990 |
| JP | 03-053606 | A | 3/1991 |
| JP | 04-061203 | A | 2/1992 |
| JP | H05-175032 | A | 7/1993 |
| JP | 06-045307 | U | 6/1994 |
| JP | H07-201570 | A | 8/1995 |
| JP | 2694757 | B2 | 12/1997 |
| JP | 2001-176717 | A | 6/2001 |
| JP | 2001-244123 | A | 9/2001 |
| JP | 2002-124408 | A | 4/2002 |
| JP | 2002-187769 | A | 7/2002 |
| JP | 2002-255637 | A | 9/2002 |
| JP | 2002-289421 | A | 10/2002 |
| JP | 2003-272912 | A | 9/2003 |
| JP | 2005-244183 | A | 9/2005 |
| JP | 2006-219306 | A | 8/2006 |
| JP | 2006-237438 | A | 9/2006 |
| JP | 2010-192890 | A | 9/2010 |
| JP | 2010-278075 | A | 12/2010 |
| KR | 2010-0094456 | A | 8/2010 |
| WO | 2007/074580 | A1 | 7/2007 |
| WO | 2010/007858 | A1 | 1/2010 |
| WO | 2010/126332 | A2 | 11/2010 |

OTHER PUBLICATIONS

Written Opinion of the International Seaching Authority; PCT/JP2012/065134; Sep. 4, 2012.

The extended European search report issued by the European Patent Office on Jun. 10, 2015, which corresponds to European Patent Application No. 12800256.5-1556 and is related to U.S. Appl. No. 14/105,062.

The extended European search report issued by the European Patent Office on Jul. 2, 2015, which corresponds to European Patent Application No. 15162012.7-1556 and is related to U.S. Appl. No. 14/105,062.

An Office Action; "Notice of Reasons for Rejection," issued by the Japanese Patent Office on Apr. 28, 2015, which corresponds to Japanese Patent Application No. 2013-520485 and is related to U.S. Appl. No. 14/105,062; with English language translation.

International Search Report; PCT/JP2012/062758; Aug. 7, 2012.

Written Opinion of the International Searching Authority; PCT/JP2012/062758; Aug. 7, 2012.

* cited by examiner

LAMINATED COIL COMPONENT, AND METHOD OF MANUFACTURING THE LAMINATED COIL COMPONENT

CROSS REFERENCE TO RELATED APPLICATIONS

The present application is a continuation of International Application No. PCT/JP2012/065134 filed on Jun. 13, 2012, and claims priority to Japanese Patent Application No. 2011-133090 filed on Jun. 15, 2011, the entire contents of each of these applications being incorporated herein by reference in their entirety.

TECHNICAL FIELD

The technical field relates to a laminated coil component, and a method for manufacturing the laminated coil component, and more particularly, relates to a laminated coil component such as a laminated inductor in which a conductor part is embedded in a magnetic body part made of a ferrite material, and a method for manufacturing the laminated coil component.

BACKGROUND

Heretofore, laminated coil components using ferrite-based ceramics such as Ni—Zn having a spinel type crystal structure are widely used, and ferrite materials are also actively developed.

This kind of laminated coil component has a structure in which a conductor part wound into a coil shape is embedded in a magnetic body part, and usually the conductor part and the magnetic body part are formed by simultaneous firing.

In the above laminated coil component, since the magnetic body part made of a ferrite material has a coefficient of linear expansion different from that of the conductor part containing a conductive material as a main component, stress-strain caused by the difference in the coefficient of linear expansion is internally produced during the process of cooling after firing. When a rapid change in temperature is produced or external stress is loaded due to reflow treatment in mounting a component on a substrate or the like, the above-mentioned stress-strain varies, and therefore magnetic characteristics such as inductance fluctuate.

Then, Japanese Unexamined Utility Model Application Publication No. 6-45307 (Patent Document 1) (see, claim 2, paragraph 0024, FIG. 2, and FIG. 7) proposes a laminated chip inductor in which a framework of a laminated chip is formed by laminated ceramic sheets, a coil conductor is formed in the laminated chip by an internal conductor, and a start end and a terminal end of the coil conductor are separately connected to external electrode terminals, and in which the ceramic sheet is a magnetic sheet, and a doughnut-shaped non-magnetic region is formed in the laminated chip so as to embrace the internal conductor excluding extraction parts to the external electrode terminals.

As described in Patent Document 1, after preparing the magnetic sheet, a non-magnetic paste is applied onto the magnetic sheet to form a non-magnetic film with a predetermined pattern, and thereafter, a printing treatment is performed in turn plural times using a magnetic paste, a paste for an internal conductor and a non-magnetic paste, and thereby, a laminated chip inductor is obtained.

In Patent Document 1, by employing a non-magnetic paste for the ceramic in contact with the coil conductor, the magnetic characteristics are prevented from fluctuating even when the stress-strain is internally produced by simultaneous firing and thereafter thermal shock is given or external stress is loaded.

On the other hand, in this kind of a laminated coil component, it is important that stable inductance is attained even when a large current is applied, and it is necessary to this end to have such a DC superposition characteristic that a reduction in inductance is suppressed even when a large DC current is applied.

However, since the laminated coil components such as a laminated inductor form a closed magnetic circuit, magnetic saturation is easily generated to decrease the inductance when a large current is applied, and desired DC superposition characteristics cannot be attained.

Hence, Japanese Patent No. 2694757 (Patent Document 2) (see, claim 1, FIG. 1, etc.) proposes a laminated coil component provided with a conductor pattern having an end connected between magnetic body layers and wound in a direction of lamination in the form of superimposition, and provided with layers of a material having lower magnetic permeability than the magnetic body layer, which are in contact with conductor patterns of both ends in the direction of lamination and located on the inside of the conductor patterns.

In Patent Document 2, by disposing a layer made of a material (for example, a Ni—Fe-based ferrite material having a small Ni content, or a non-magnetic material) having lower magnetic permeability than the magnetic body layer on the outside of the conductor pattern, a magnetic flux is prevented from concentrating at a corner on the inside of the conductor pattern at an end, and the magnetic flux is dispersed toward the center of the main magnetic path, and thereby, the occurrence of magnetic saturation is prevented to improve inductance.

Further, Japanese Patent Laid-open Publication No. 2006-237438 (Patent Document 3) (see, claim 1 and paragraph 0007) proposes a laminated bead in which a magnetic body layer and a conductor pattern are laminated, and an impedance element is formed in a base, wherein a sintering modifier for adjusting the sinterability of the magnetic body layer is mixed in a conductive paste.

In Patent Document 3, the sintering modifier is composed of $SiO_2$ with which a silver powder is coated, $SiO_2$ contains silver in an amount of 0.05 to 0.3 wt %, and the conductive paste including the mixed sintering modifier is printed on a magnetic body layer to form a conductor pattern.

Further, in Patent Document 3, by mixing the sintering modifier in the conductive paste, since the sintering modifier is moderately diffused in the magnetic body, it is possible to delay the progress of sintering of the magnetic body near the conductor pattern compared with other portions, and thereby, a magnetically inactive layer is formed in a manner of functional gradient. That is, by delaying the progress of the sintering of the magnetic body near the conductor pattern compared with other portions, the grain size of the magnetic body between the conductor patterns or near the conductor pattern becomes smaller than that in other portions to enable formation of a low-magnetic permeability layer, and a magnetically inactive portion is formed. Thereby, it is intended to improve the DC superposition characteristics to a large current region in a high-frequency band to prevent the deterioration of magnetic characteristics.

SUMMARY

The present disclosure provides a laminated coil component having excellent thermal shock resistance in that the fluctuation of inductance is small even when thermal shock is given or external stress is loaded, a laminated coil component having excellent DC superposition characteristics without requiring a complicated process, and a method for manufacturing the laminated coil component.

An embodiment of a laminated coil component according to the present disclosure is a laminated coil component having a magnetic body part made of a ferrite material and a conductor part wound into a coil shape. The conductor part being embedded in the magnetic body part to form a component base. The component base is divided into a first region near the conductor part and a second region other than the first region, the grain size ratio of the average crystal grain size of the magnetic body part in the first region to the average crystal grain size of the magnetic body part in the second region is 0.9 or less, the ferrite material contains at least a Cu component, and the content of the Cu component is 0.2 to 4 mol % in terms of CuO.

In a more specific embodiment, the laminated coil component has the grain size ratio of 0.8 or less.

In another more specific embodiment, in laminated coil component, the content of Cu component may be 0.4 to 4 mol % in terms of CuO.

In still another more specific embodiment, in the laminated coil component, the conductor part may contain Ag as a main component.

In yet another more specific embodiment, in the laminated coil component, the ferrite material may contain a Sn component.

In a further specific embodiment, the above Sn component may be 0.1 to 3.0 parts by weight in terms of $SnO_2$ with respect to 100 parts by weight of a main component.

In another more specific embodiment, in the laminated coil component, the component base may be formed by being sintered in a firing atmosphere in which the oxygen concentration is 0.001 to 0.1 volume %.

In yet another more specific embodiment, the component base laminated coil component may include a non-magnetic sheet provided across the conductor part and having a major surface perpendicular to an axial direction of the coil shape.

In another more specific embodiment, in the component base, the second region substantially surrounds the first region.

An embodiment of a method for manufacturing a laminated coil component according to the present disclosure includes a magnetic sheet preparation step of preparing a magnetic sheet from a ferrite raw material powder containing at least a Cu oxide; a paste preparation step of preparing a conductive paste containing Ag as a main component; a coil pattern formation step of forming a coil pattern on a surface of the magnetic sheet by applying the conductive paste onto the magnetic sheet; a laminated body formation step of laminating the magnetic sheets provided with the formed coil pattern in a predetermined direction to form a laminated formed body; and a firing step of firing the laminated formed body in a firing atmosphere in which the oxygen concentration is 0.1 volume % or less to prepare a component base in which an internal conductor is embedded in a magnetic body.

In a more specific embodiment of the above method of manufacturing a laminated coil component, the oxygen concentration may be 0.001 volume % or more.

In another more specific embodiment of the above method of manufacturing a laminated coil component, the ferrite raw material powder may contain a Sn component.

In a further specific embodiment of the above method of manufacturing a laminated coil component, the Sn component may be 0.1 to 3.0 parts by weight in terms of $SnO_2$ with respect to 100 parts by weight of a main component.

In yet another more specific embodiment of the above method of manufacturing a laminated coil component, the content of the Cu component of the ferrite raw material powder may be 0.4 to 4 mol % in terms of CuO.

In another more specific embodiment of the above method of manufacturing a laminated coil component, the laminated body preparation step may further include providing a non-magnetic sheet between two of the magnetic sheets.

DETAILED DESCRIPTION

However, the present inventors realized that in Patent Document 1, printing has to be performed by using alternately a plurality of pastes such as the magnetic paste and the non-magnetic paste in addition to the paste for an internal conductor, resulting in a complicated manufacturing process and lack of practicality. Furthermore, in the case where the magnetic paste and the non-magnetic paste have different component systems, residual stress is generated in firing both the pastes simultaneously due to the difference in shrinkage behavior, and there is a possibility that defects such as cracks are developed.

The inventors also realized that in Patent Document 2, since printing has to be performed by preparing a plurality of magnetic pastes having different compositions, or the magnetic paste and the non-magnetic paste, as with Patent Document 1, the manufacturing process is complicated and lacks practicality.

Moreover, in the method of Patent Document 3, since a sintering modifier is mixed in the conductive paste, there is a possibility that resistance of a conductor pattern obtained by sintering the conductive paste is inevitably increased and DC resistance (Rdc) is increased.

Exemplary embodiments of the present disclosure that can address the above shortcomings will be described hereafter in detail.

The present inventors made earnest investigations using a Ni—Zn-based ferrite material, and consequently obtained findings that when the difference in sinterability is made between a region near a conductor part (first region) and a region (second region) other than the region near a conductor part in firing treatment to make the sinterability of the first region lower than the sinterability of the second region, thermal shock resistance and DC superposition characteristics can be improved.

That is, in order to improve the thermal shock resistance and the DC superposition characteristics, it is effective to make the difference in sinterability between the first region and the second region. For this purpose, it is necessary to suppress the grain growth of a crystal grain in the first region in firing.

Then, the present inventors further made earnest investigations in order to suppress the grain growth of a crystal grain in the first region in firing, and consequently found that when a Cu component is contained in the ferrite material in such a way that the content of the Cu component is 0.2 to 4 mol % in terms of CuO and the ferrite material is fired in an atmosphere of low oxygen concentration, the grain size ratio of the average crystal grain size in the first region to the average crystal grain size in the second region can be suppressed to 0.9 or less, and thereby, the thermal shock resistance and the DC superposition characteristics can be improved.

Figure 1:
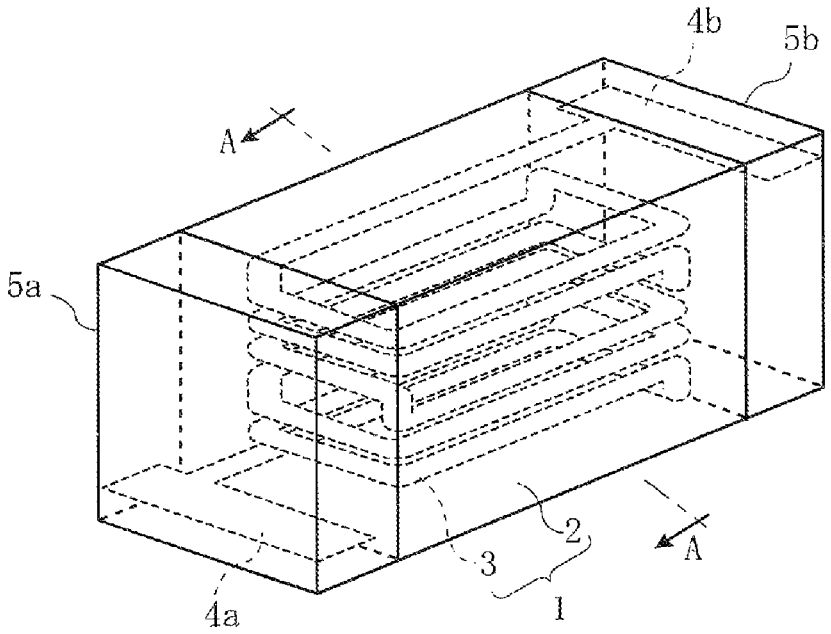
FIG. 1 is a perspective view showing an exemplary embodiment (first embodiment) of a laminated inductor as a laminated coil component.
Figure 2:
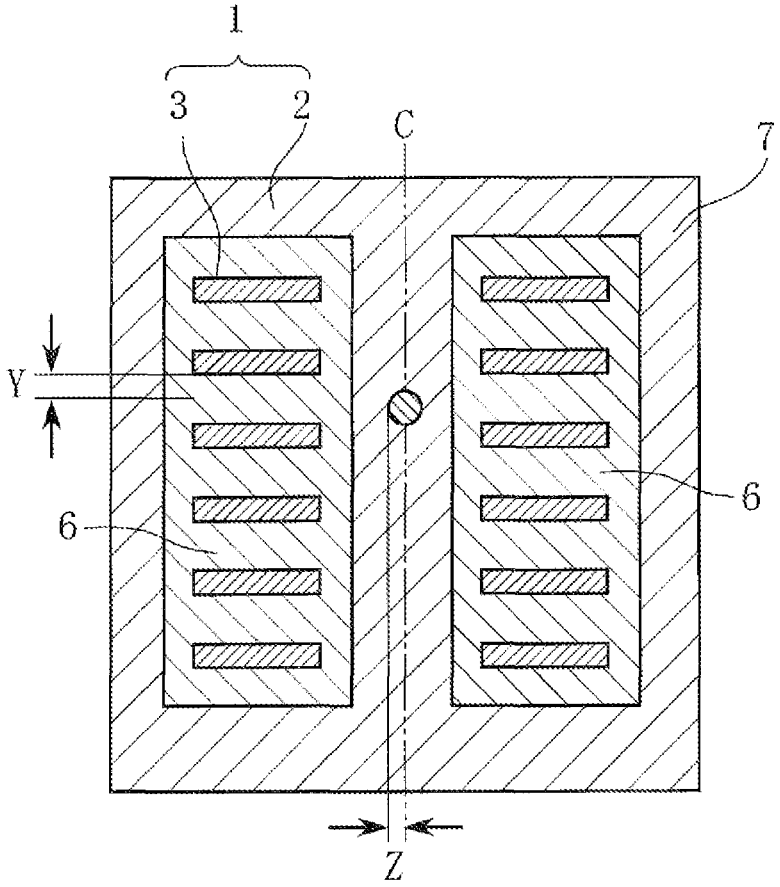
FIG. 2 is a sectional view (transverse sectional view) taken on line A-A of FIG. 1.

FIG. 1 is a perspective view showing an exemplary embodiment of a laminated inductor as a laminated coil component according to the present disclosure, and FIG. 2 is a sectional view (transverse sectional view) taken on line A-A of FIG. 1.

In the present laminated inductor example, a component base 1 has a magnetic body part 2 and a coil conductor (conductor part) 3, and the coil conductor 3 is embedded in the magnetic body part 2. Further, extraction electrodes 4*a* and 4*b* are formed at both ends of the coil conductor 3, external electrodes 5*a* and 5*b* made of Ag or the like are formed at both ends of the component base 1, and the external electrodes 5*a* and 5*b* are electrically connected to the extraction electrodes 4*a* and 4*b*.

In the present embodiment, the magnetic body part 2 is formed from a ferrite material containing the respective components of Fe, Zn, Ni and Cu as main components, and the coil conductor 3 is formed from a conductive material containing Ag as a main component.

The magnetic body part 2 is, as shown in FIG. 2, divided into a first region 6 that is near the coil conductor 3 and a second region 7 other than the first region 6, and as shown in the equation (1), the ratio of the average crystal grain size D1 of the first region 6 to the average crystal grain size D2 of the second region 7 is set to 0.9 or less.

$$D1/D2 \leq 0.9 \quad (1)$$

Thereby, the second region 7 has good sinterability because of grain growth promoted during firing, and forms a high-density region with a high sintered density, and on the other hand, the first region 6 forms a low-density region with a low sintered density which is inferior in sinterability to the second region and in which the grain growth of a crystal grain is suppressed.

That is, in the first region 6, the average crystal grain size is smaller than that in the second region 7, and the grain growth is suppressed during firing, resulting in low sinterability, and the sintered density is lowered. Therefore, internal stress can be mitigated and the fluctuation of the magnetic characteristics such as inductance can be suppressed even when thermal shock or external stress is loaded.

Further, since the first region 6, as described above, has low sinterability, the magnetic permeability μ is reduced and the DC superposition characteristics are improved, and thereby, concentration of a magnetic flux is largely mitigated, and magnetic saturation hardly occurs.

In addition, when the grain size ratio D1/D2 between the average crystal grain size D1 in the first region 6 and the average crystal grain size D2 in the second region 7 exceeds 0.9, the adequate difference in sinterability is not produced between the first region 6 and the second region 7 even if the grain size ratio D1/D2 is 1 or less. Also, it is not preferable for the grain size ratio D1/D2 to exceed 1 because the sinterability of the first region 6 becomes higher than that of the second region 7 in view of the grain growth promoted in region 6 more than in the second region 7.

Further, by setting the molar content of the Cu component in the magnetic body part 2 to 0.2 to 4 mol % in terms of CuO and firing the magnetic body part 2 after adjusting the atmosphere so that the oxygen concentration is 0.001 to 0.1 volume %, it becomes possible to easily control the grain size ratio D1/D2 so as to be 0.9 or less.

That is, in order to attain good DC superposition characteristics, it is necessary to increase the saturated magnetic flux density Bs, and for this purpose, it is said to be effective to reduce the molar content of CuO.

On the other hand, in the Ni—Zn—Cu-based ferrite material, when the molar content of CuO having a low melting point of 1026° C. is reduced, sinterability is deteriorated. Thus, in general, the ferrite material contains CuO in an amount of 8 mol % or more.

However, as the results of investigations by the present inventors, it was found that, by adjusting the firing atmosphere to an atmosphere of low oxygen concentration in which the oxygen concentration is 0.1 volume % or less, low-temperature sinterability can be improved, and it becomes possible to decrease the firing temperature even when the molar content of CuO in the ferrite raw material is reduced.

That is, when the oxygen concentration in the firing atmosphere exceeds 0.1 volume %, it is difficult to form adequate oxygen defects in a crystal structure, but in the low-oxygen atmosphere in which the oxygen concentration in the firing atmosphere is 0.1 volume % or less, formation of the oxygen defects is promoted in a crystal structure. When oxygen defects are formed in a crystal structure as described above, the interdiffusion of the ferrite components (Fe, Ni, Cu, Zn) existing in a crystal is promoted, and thereby, low-temperature sinterability can be improved, and it becomes possible to decrease the firing temperature to about 900 to 930° C. at which the ferrite raw material can be fired simultaneously with Ag. Furthermore, as described above, by reducing the molar content of CuO, it also becomes possible to improve DC superposition characteristics.

Herein, the molar content of CuO is set to 0.2 to 4 mol % for the following reason.

When firing is performed in the low-oxygen atmosphere in which the oxygen concentration is 0.1 volume % or less, CuO is easily deposited as a heterophase in a crystal grain compared with the case where firing is performed in the atmosphere. Further, when the molar content of CuO is higher than 4 mol %, there is a possibility that CuO is excessively deposited in a crystal grain, and the sinterability of the entire magnetic body part 2 is deteriorated conversely due to the deposition of CuO, and therefore the grain growth of a crystal grain is also suppressed in the second region 7, and the grain size ratio D1/D2 may exceed 0.9.

On the other hand, when the molar content of CuO is less than 0.2 mol %, since the molar content of CuO having a low melting point is excessively low, adequate sinterability cannot be achieved even when firing is performed in an atmosphere of low oxygen concentration, and the grain growth is also suppressed in the second region 7.

Accordingly, in order to make the grain size ratio D1/D2 0.9 or less, the molar content of the Cu component in the ferrite raw material is preferably set to 0.2 to 4 mol %, and more preferably set to 0.4 to 4 mol % in terms of CuO.

As described above, when the molar content of the Cu component in the ferrite raw material is set to 0.2 to 4 mol % in terms of CuO and the ferrite raw material and the coil conductor 3 containing Ag as a main component are fired simultaneously in a firing atmosphere in which the oxygen concentration is 0.1 volume % or less, Ag absorbs CuO in the first region 6 near the coil conductor 3 to segregate CuO in the vicinity of the coil conductor 3. Consequently, the weight content of CuO is reduced in the first region 6, and thereby, the sinterability is deteriorated in the first region 6. That is, in the first region 6, the grain growth is suppressed, resulting in a decrease in the average grain size of a crystal grain and a decrease in the sintered density. Thereby, internal stress is mitigated and the fluctuation of the magnetic characteristics such as inductance can be suppressed even when thermal shock is given or external stress is loaded due to the reflow treatment in mounting a component on a substrate or the like. Further, in the first region 6 with a low sintered density, since the magnetic permeability is reduced, the DC superposition characteristics are improved, and therefore concentration of a magnetic flux is largely mitigated and magnetic saturation hardly occurs.

The lower limit of the oxygen concentration in the firing atmosphere is not particularly limited, but the oxygen concentration is preferably 0.001 volume % or more from the viewpoint of avoiding the reduction of specific resistance due to excessive formation of the oxygen defect.

The contents of the respective components for forming a main component other than a Cu component in the ferrite composition, namely, the contents of the respective components of Fe, Zn, and Ni, are not particularly limited, but it is preferred that the contents of the respective components are 40 to 49.5 mol %, 5 to 35 mol %, and the rest in terms of $Fe_2O_3$, ZnO and NiO, respectively, from the viewpoint of achieving good characteristics in magnetic permeability, sinterability and Curie point.

In addition, the average crystal grain size and the weight content of a Cu component are measured by the following method.

That is, in the first region 6, the average crystal grain size and the weight content of a Cu component are measured in a region of a distance (denoted by Y in FIG. 2) of 1 to 10 μm from an interface between the magnetic body part 2 and the coil conductor 3.

Further, in the second region 7, the average crystal grain size and the weight content of a Cu component are measured in a region which is inside of the coil conductor 3 and ±50 μm or less from a center axis C (denoted by Z in FIG. 2) in a width direction of the magnetic body part 2.

When the average crystal grain size is measured in this way, it is confirmed that the grain size ratio D1/D2 is 0.9 or less, and the weight content of a Cu component in the first region 6 is reduced compared with the weight content of a Cu component in the second region 7.

Figure 3:
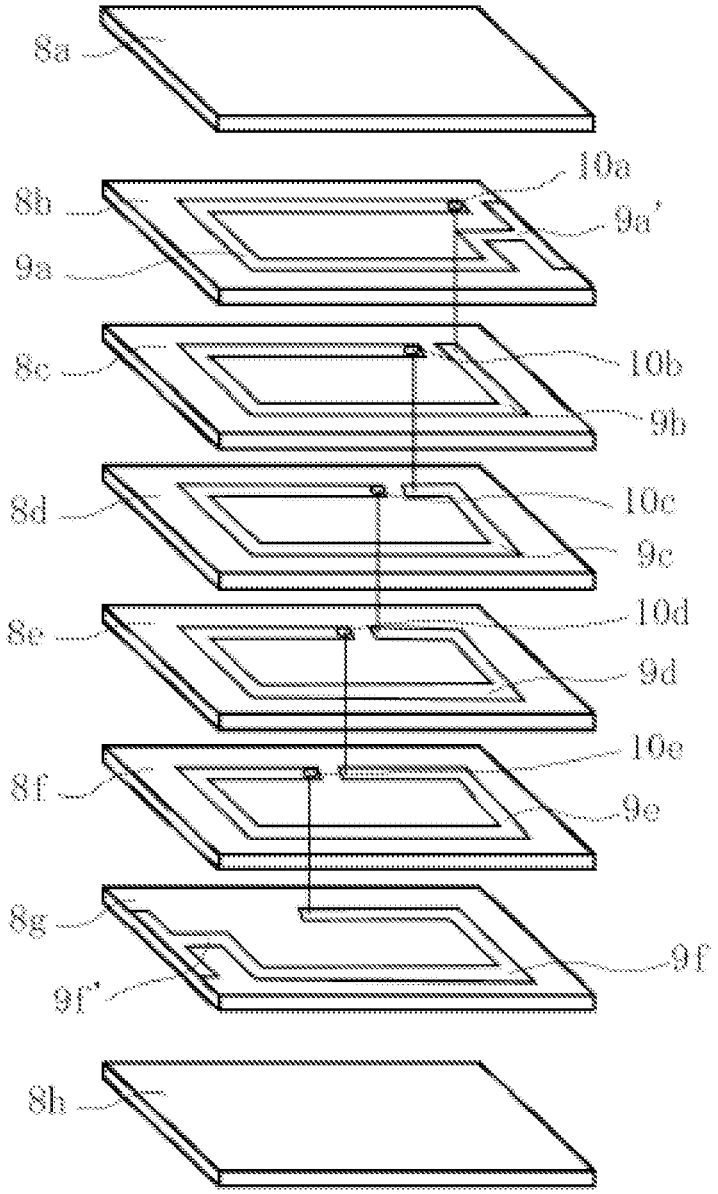
FIG. 3 is an exploded perspective view for illustrating an exemplary method for manufacturing the laminated inductor.

Next, an exemplary method for manufacturing the laminated inductor will be described in detail in reference to FIG. 3.

First, as crude materials of ferrite, an Fe oxide, a Zn oxide, a Ni oxide and a Cu oxide are prepared. Then, these crude materials of ferrite are respectively weighed so as to be 40 to 49.5 mol %, 5 to 35 mol %, 0.2 to 4 mol % and the rest in terms of $Fe_2O_3$, ZnO, CuO and NiO, respectively, for example.

Then, these weighed materials are put in a pot mill together with pure water and balls such as PSZ (partially stabilized zirconia) balls, subjected to adequate wet mixing and grinding, and dried by evaporation, and then calcined at a temperature of 700 to 750° C. for a predetermined period of time.

Next, these calcined materials are put again in a pot mill together with an organic binder such as polyvinyl butyral, an organic solvent such as ethanol or toluene, and PSZ balls, and subjected to adequate mixing and grinding to prepare a ferrite slurry.

Next, the ferrite slurry is formed into a sheet by using a doctor blade method or the like to prepare magnetic sheets 8*a* to 8*h* having a predetermined film thickness.

Then, via holes are formed at predetermined locations of the magnetic sheets 8*b* to 8*g* by use of a laser beam machine so that the magnetic sheets 8*b* to 8*g* of the magnetic sheets 8*a* to 8*h* can be electrically connected to one another.

Next, a conductive paste for a coil conductor containing Ag as a main component is prepared. Then, coil patterns 9*a* to 9*f* are formed on the magnetic sheets 8*b* to 8*g* by screen printing by using the conductive paste, and via hole conductors 10*a* to 10*e* are prepared by filling via holes with the conductive paste. In addition, extraction parts 9*a*' and 9*f*' are formed at the coil patterns 9*a* and 9*f*, respectively formed on the magnetic sheets 8*b* and 8*g* so as to be electrically connected to external electrodes.

Then, the magnetic sheets 8*b* to 8*g* having the coil patterns 9*a* to 9*f* formed thereon are laminated, and the resulting laminate is supported by sandwiching it between the magnetic sheets 8*a* and 8*h* on each of which the coil pattern is not formed, and press-bonded, and thereby, a press-bonded block, in which the coil patterns 9*a* to 9*f* are connected with the via hole conductors 10*a* to 10*e* interposed therebetween, is prepared. Thereafter, the press-bonded block is cut into a predetermined dimension to prepare a laminated formed body.

Next, the laminated formed body is adequately degreased at a predetermined temperature in the atmosphere, and then is supplied to a firing furnace in which the oxygen concentration is adjusted to 0.001 to 0.1 volume %, and fired at 900 to 930° C. for a predetermined time, and thereby, a component base 1, in which a coil conductor 3 is embedded in a magnetic body part 2, is obtained.

In addition, in this firing treatment, CuO in the magnetic sheets 8*b* to 8*g* near the coil patterns 9*a* to 9*f* is absorbed by Ag in the coil patterns 9*a* to 9*f* to segregate CuO around the coil conductor 3 after firing, and thereby, the magnetic body part 2 is divided into the first region 6 with a low sintered density and the second region 7 with high sinterability and a high sintered density other than the first region 6.

Next, a conductive paste for an external electrode containing a conductive powder such as a Ag powder, glass frits, varnish and an organic solvent is applied onto both ends of the component base 1, and dried, and then baked at 750° C. to form external electrodes 5*a* and 5*b*, and thereby, a laminated inductor is prepared.

As described above, in the present embodiment, since the component base 1 is divided into the first region 6 near the coil conductor 3 and the second region 7 other than the first region 6, and the grain size ratio of the average crystal grain size of the magnetic body part 2 in the first region 6 to the average crystal grain size of the magnetic body part 2 in the second region 7 is 0.9 or less, the grain growth in the first region 6 during firing is suppressed compared with the second region 7, resulting in the reduction in sinterability, and consequently a magnetic permeability of the first region 6 is also reduced. Then, in the first region 6 near the coil conductor 3, since the sintered density is lowered because of a decrease in sinterability, internal stress can be mitigated, and the fluctuation of the magnetic characteristics such as inductance can be suppressed even when thermal shock or external stress is applied due to the reflow treatment in mounting a component on a substrate or the like. Further, in the first region 6, since the magnetic permeability is reduced, the DC superposition characteristics are improved, and therefore concentration of a magnetic flux is largely mitigated, and the saturated magnetic flux density can be improved.

Furthermore, since the content of the Cu component is 0.2 to 4 mol % (more preferably 0.4 to 4 mol %) in terms of CuO, the grain growth in the first region 6 can be suppressed without impairing the grain growth in the second region 7 even when firing is carried out in a firing atmosphere of low oxygen concentration of 0.001 to 0.1 volume %, and thereby, the grain size ratio can be easily made 0.9 or less (preferably 0.8 or less), and it becomes possible to obtain a laminated coil component such as a laminated inductor having excellent thermal shock resistance and DC superposition characteristics.

Further, when the coil conductor 3 contains Ag as a main component and thereby, the magnetic sheets 8*a* to 8*h* to serve as a magnetic body part 2 contain CuO, if the conductor part and the magnetic body part are fired simultaneously under a low oxygen concentration, CuO contained in the magnetic body part 2 near the coil conductor 3 is absorbed by Ag, and thereby, the amount of CuO in the first region 6 is reduced to deteriorate the sinterability of the first region 6 compared with the sinterability of the second region 7, and the grain size ratio can be easily decreased to 0.9 or less.

As described above, in accordance with the present embodiment, it is possible to obtain a laminated coil component which has excellent thermal shock resistance that the changes in magnetic characteristics such as inductance are suppressed even when thermal shock is given or external stress is loaded due to the reflow treatment in mounting a component on a substrate or the like, and has excellent DC superposition characteristics.

Figure 4:
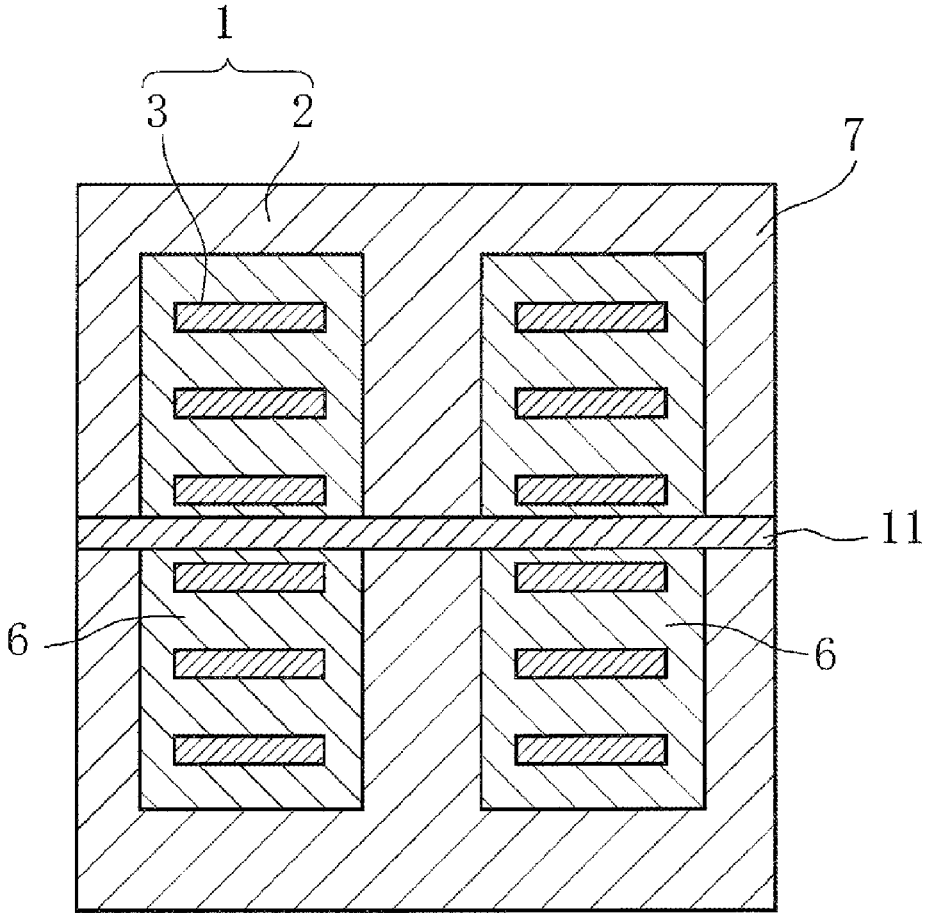
FIG. 4 is a transverse sectional view showing a second exemplary embodiment of the laminated inductor.

FIG. 4 is a transverse sectional view showing a second exemplary embodiment of the laminated coil component of the present disclosure. In the second embodiment, a non-magnetic body layer or sheet 11 is disposed in such a manner as to cross a magnetic path to serve as an open magnetic circuit. By employing the open magnetic circuit, the DC superposition characteristics can be further improved.

Herein, as the non-magnetic body layer 11, materials having similar shrinkage behaviors in firing, for example, Zn—Cu-based ferrite obtained by substituting all Ni of Ni—Zn—Cu-based ferrite with Zn or Zn-based ferrite, can be used.

Further, also in the case where the non-magnetic body layer 11 is formed as in the second embodiment, the average crystal grain size and the weight content of a Cu component are measured at the position described in the first embodiment, but since it is not preferred to measure them at a position in the vicinity of the non-magnetic body layer 11, for both cases of the first region 6 and the second region 7, it is preferred to measure them at a position 50 μm or more away from the non-magnetic body layer 11 in a thickness direction.

The present disclosure is not limited to the above embodiment. In the above embodiment, the magnetic body part 2 is formed from a ferrite material containing the respective components of Fe, Ni, Zn and Cu as the main components, but in a preferred embodiment, the ferrite material can contain an Sn component in an appropriate amount (e.g., 0.1 to 3 parts by weight in terms of $SnO_2$ with respect to 100 parts by weight of a main component) as an accessory component, and thereby, the DC superposition characteristics can be further improved.

In the above embodiment, while the laminated inductor has been described, it is needless to say that the present disclosure can be applied to laminated composite components such as a laminated LC component.

Next, examples consistent with the present disclosure will be described specifically.

Example 1

Preparation of Sample

Preparation of Magnetic Sheet: As crude materials of ferrite, $Fe_2O_3$, ZnO, NiO and CuO were prepared, and these crude materials of ferrite were respectively weighed so as to have the composition shown in Table 1. That is, the amounts of $Fe_2O_3$ and ZnO were set to 49.0 mol % and 30.0 mol %, respectively, and the amount of CuO was varied in a range of 0.0 to 7.0 mol %, and the rest was adjusted by NiO.

TABLE 1

| Sample | Ferrite Composition (mol %) | | | |
|---|---|---|---|---|
| No. | $Fe_2O_3$ | ZnO | CuO | NiO |
| 1* | 49.0 | 30.0 | 0.0 | 21.0 |
| 2** | 49.0 | 30.0 | 0.2 | 20.8 |
| 3 | 49.0 | 30.0 | 0.4 | 20.6 |
| 4 | 49.0 | 30.0 | 0.5 | 20.5 |
| 5 | 49.0 | 30.0 | 0.7 | 20.3 |
| 6 | 49.0 | 30.0 | 1.0 | 20.0 |
| 7 | 49.0 | 30.0 | 2.0 | 19.0 |
| 8 | 49.0 | 30.0 | 3.0 | 18.0 |
| 9 | 49.0 | 30.0 | 4.0 | 17.0 |
| 10* | 49.0 | 30.0 | 5.0 | 16.0 |
| 11* | 49.0 | 30.0 | 6.0 | 15.0 |
| 12* | 49.0 | 30.0 | 7.0 | 14.0 |

*indicates out of the scope of the present disclosure
**indicates out of the scope of the present disclosure Then, these weighed materials were put in a pot mill made of vinyl chloride together with pure water and PSZ balls, subjected to adequate wet mixing and grinding, and dried by evaporation, and then calcined at a temperature of 750° C.

Then, the above calcined materials were put again in a pot mill made of vinyl chloride together with a polyvinyl butyral-based binder (an organic binder), ethanol (an organic solvent), and PSZ balls, and subjected to adequate mixing and grinding to prepare a slurry.

Next, the above slurry was formed into a sheet so as to have a thickness of 25 μm by using a doctor blade method, and the resulting sheet was punched out into a size of 50 mm in length and 50 mm in width to prepare a magnetic sheet.

Then, a via hole was formed at a predetermined location of the magnetic sheet by use of a laser beam machine, then a Ag paste containing a Ag powder, varnish and an organic solvent was applied onto the surface of the magnetic sheet by screen printing, and the Ag paste was filled into the via hole, and thereby, a coil pattern having a predetermined shape and a via hole conductor were formed.

Preparation of Non-magnetic Sheet: $Fe_2O_3$ and ZnO were weighed so as to be 49.0 mol % and 51.0 mol %, respectively, and calcined by the same method/procedure as previously described, and then calcined materials were formed into slurry, and thereafter, the slurry was formed into a sheet so as to have a thickness of 25 μm by using a doctor blade method, and the resulting sheet was punched out into a size of 50 mm in length and 50 mm in width to prepare a non-magnetic sheet.

Then, a via hole was formed at a predetermined location of the non-magnetic sheet by use of a laser beam machine, then a Cu paste containing a Cu powder, varnish and an organic solvent was filled into the via hole, and thereby, a via hole conductor was formed.

Preparation of Sintered Body: The magnetic sheet having the coil pattern formed thereon, the non-magnetic sheet, and the magnetic sheet having the coil pattern formed thereon were laminated in turn so that the non-magnetic sheet is sandwiched between the magnetic sheets at substantially the center thereof, and thereafter the resulting laminate was sandwiched between the magnetic sheets not having the coil pattern, and these sheets were press-bonded at a pressure of 100 MPa at a temperature of 60° C. to prepare a press-bonded block. Then, the press-bonded block was cut into a predetermined size to prepare a laminated formed body.

Next, the laminated formed body was adequately degreased at 400° C. in the atmosphere. Thereafter, the laminated formed body was charged into a firing furnace in which the oxygen concentration was adjusted to 0.1%, and held in a temperature range of 900 to 930° C. for 1 to 5 hours to be fired, and thereby, component bases of the sample Nos. 1 to 12, in which a coil conductor was embedded in a magnetic body part, were prepared.

Next, a conductive paste for an external electrode containing an Ag powder, glass frits, varnish and an organic solvent was prepared. Then, the conductive paste for an external electrode was applied onto both ends of the ferrite body, and dried, and then baked at 750° C. to form external electrodes, and thereby, samples (laminated inductors) of the sample Nos. 1 to 12 were prepared.

With respect to the outer dimension of each sample, the length L was 2.0 mm, the width W was 1.2 mm, and the thickness T was 1.0 mm, and the number of coil turns was adjusted in such a way that the inductance was about 1.0 μH.

Evaluation of Samples: On each of samples of the sample Nos. 1 to 12, the weight content of CuO and the average crystal grain size were measured.

Figure 5:
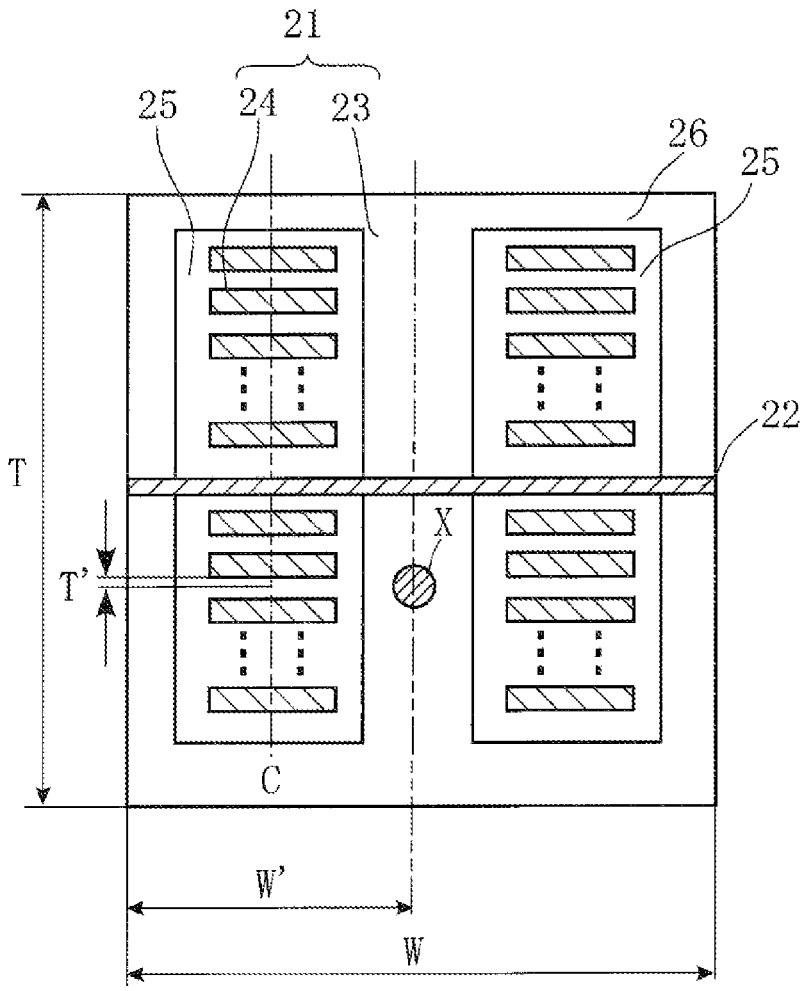
FIG. 5 is a drawing showing measuring points of the crystal grain size and composition in examples.

FIG. 5 is a sectional view showing measuring points of the weight content of CuO and the average crystal grain size, and in the component base 21 of each sample, a non-magnetic body layer 22 is formed roughly in the center, and a coil conductor 24 is embedded in a magnetic body part 23.

In the first region 25 near the coil conductor 24, a position, which is on the center line C of the coil conductors 24 and at distances T' of 5 μam from the coil conductors 24, is taken as a measurement position, and the weight content of CuO and the average crystal grain size at the measurement position were determined.

In the second region 26, a position (denoted by X in FIG. 5) in which W' corresponding to the center of the magnetic body part 23 of 1.2 mm in width W was 0.6 mm and which is about 100 μm away from the non-magnetic body layer 22 at substantially the center in the thickness direction is taken as a measurement position, and the weight content of CuO and the average crystal grain size at the measurement position were determined.

Specifically, the weight content of CuO was determined by fixing 10 of each of samples of the sample Nos. 1 to 12 with a resin, with the external electrode down, and about a half-portion of the sample in the longitudinal direction was polished. The composition of each magnetic body part 23 of the polished cross section was quantitatively analyzed by using a WDX method (wavelength-dispersive X-ray spectroscopy) to determine the weight content of CuO (average value) in the magnetic body part 23 in the first region 25 and the second region 26.

With respect to the average crystal grain size of CuO, as with the above case, 10 of each sample were polished, then chemically etched, a SEM photograph at the measurement point described above of each etched sample was taken, grain sizes in the first region 25 and the second region 26 were measured from the SEM photographs and converted to equivalent circle diameters according to JIS standard (R 1670), and the average crystal grain size was calculated to determine the average value of 10 samples.

Thereafter, a thermal shock test and a DC superposition test were performed, and inductances before and after the respective tests were measured to determine their change rates and evaluate the thermal shock resistance and the DC superposition characteristics.

Specifically, in the thermal shock test, 50 of each sample were subjected to a predetermined heat cycle test in the range of −55° C. to +125° C. 2000 times, and inductances L before and after the test were measured at a measurement frequency of 1 MHz to determine inductance change rates before and after the test.

Further, in the DC superposition test, on 50 of each sample, inductance L at the time when a DC current of 1 A was superposed on the sample was measured at a measurement frequency of 1 MHz according to JIS standard (C 2560-2) to determine inductance change rates before and after the test.

Table 2 shows measured results of each sample of the sample Nos. 1 to 12.

TABLE 2

| | | Weight Content of CuO (weight %) | | Average Crystal Grain Size (μm) | | | Inductance Change Rate (%) | |
|---|---|---|---|---|---|---|---|---|
| Sample No. | Molar Content of CuO (mol %) | First Region x1 | Second Region x2 | First Region D1 | Second Region D2 | Grain Size Ratio D1/D2 | Thermal Shock Test | DC Superposition Test |
| 1* | 0.0 | 0.00 | 0.00 | 0.52 | 0.52 | 1.00 | +22.2 | −50.5 |
| 2** | 0.2 | 0.04 | 0.14 | 0.51 | 0.58 | 0.88 | +12.5 | −38.8 |
| 3 | 0.4 | 0.08 | 0.28 | 0.52 | 0.71 | 0.73 | +7.9 | −30.8 |
| 4 | 0.5 | 0.11 | 0.35 | 0.53 | 0.93 | 0.57 | +6.8 | −29.7 |
| 5 | 0.7 | 0.15 | 0.48 | 0.54 | 1.22 | 0.44 | +5.1 | −28.8 |
| 6 | 1.0 | 0.20 | 0.67 | 0.53 | 1.81 | 0.29 | +3.2 | −22.5 |
| 7 | 2.0 | 0.43 | 1.36 | 0.95 | 2.30 | 0.41 | +5.4 | −28.4 |
| 8 | 3.0 | 0.62 | 2.03 | 1.69 | 2.39 | 0.71 | +8.8 | −30.5 |
| 9 | 4.0 | 0.83 | 2.68 | 1.92 | 2.44 | 0.79 | +9.1 | −34.2 |
| 10* | 5.0 | 1.05 | 3.37 | 2.52 | 2.51 | 1.00 | +22.5 | −51.1 |
| 11* | 6.0 | 1.26 | 4.05 | 2.50 | 2.48 | 1.01 | +24.8 | −52.2 |
| 12* | 7.0 | 1.49 | 4.72 | 2.48 | 2.47 | 1.00 | +25.1 | −52.8 |

*indicates out of the scope of the present disclosure
indicates out of the scope of the present disclosure The sample No. 1 exhibited the inductance change rate as large as +22.2% in the thermal shock test, and the inductance change rate as large as −50.5% in the DC superposition test, and the sample was found to be inferior in the thermal shock resistance and the DC superposition characteristics. The reason for this is probably that the ferrite material does not contain CuO, therefore the grain size ratio D1/D2 is 1.00, the difference in average crystal grain size was not observed between the first region 25 and the second region 26, and the entire magnetic body part 23** is low in sinterability.

Further, the sample Nos. 10 to 12 also exhibited the inductance change rate as large as +22.5 to +25.1% in the thermal shock test, and the inductance change rate as large as −51.1 to −52.8% in the DC superposition test, and these samples were found to be inferior in the thermal shock resistance and the DC superposition characteristics. The reason for this is probably that the molar content of CuO was as high as 5.0 to 7.0 mol %, and therefore a heterophase of CuO was produced in a crystal grain to deteriorate the sinterability conversely, and the grain size ratio D1/D2 was 1.00 to 1.01 and exceeded 0.9.

On the other hand, in each of the sample Nos. 2 to 9, since the molar content of CuO was 0.2 to 4.0 mol % and the grain size ratio D1/D2 was 0.9 or less, the inductance change rate was as small as +3.2 to +12.5% in the thermal shock test, and the inductance change rate was as small as −22.5 to −38.8% in the DC superposition test, and the results were improved. Particularly, in each of the sample Nos. 3 to 9, since the molar content of CuO was 0.4 to 4.0 mol %, the grain size ratio D1/D2 was 0.8 or less, and consequently the inductance change rate was 10% or less in the absolute value in the thermal shock test, and the inductance change rate was 35% or less in the absolute value in the DC superposition test, and these samples were found to have better results.

Further, the weight content x1 of CuO in the first region 25 was reduced compared with the weight content x2 of CuO in the second region 26. The reason for this is probably that Ag composing the coil conductor 24 absorbed CuO in the first region 25 during a firing process, and thereby, the weight content x1 of CuO in the first region 26 was reduced. It is thought that the difference in sinterability occurred between the first region 25 and the second region 26 by the difference between the weight contents of CuO, and consequently the difference in average grain size occurred between both the regions, and thereby, the thermal shock resistance and the DC superposition characteristics were improved.

Example 2

$Fe_2O_3$, ZnO, NiO and CuO for forming the main components of the ferrite materials, and $SnO_2$ as an accessory component material were prepared. Then, $Fe_2O_3$, ZnO, CuO and NiO were weighed so as to be 49.0 mol %, 30.0 mol %, 1.0 mol % and 20.0 mol %, respectively, and further, $SnO_2$ was weighed so as to be 0.0 to 3.0 parts by weight with respect to 100 parts by weight of the main component.

Except for these, samples of the sample Nos. 21 to 28 were prepared by following the same method/procedure as in Example 1.

Next, on each sample of the sample Nos. 21 to 28, the weight content of CuO and the average crystal grain size were measured by following the same method/procedure as in Example 1 and a thermal shock test and a DC superposition test were performed.

Table 3 shows measured results of each sample of the sample Nos. 21 to 28.

TABLE 3

| Sample No. | Weight Content of $SnO_2$ (parts by Weight) | Weight Content of CuO (weight %) First Region x1 | Weight Content of CuO (weight %) Second Region x2 | Average Crystal Grain Size (μm) First Region D1 | Average Crystal Grain Size (μm) Second Region D2 | Grain Size Ratio D1/D2 | Inductance Change Rate (%) Thermal Shock Test | Inductance Change Rate (%) DC Superposition Test |
|---|---|---|---|---|---|---|---|---|
| 21*** | 0.0 | 0.20 | 0.67 | 0.53 | 1.81 | 0.29 | +3.2 | −22.5 |
| 22 | 0.1 | 0.20 | 0.67 | 0.51 | 1.78 | 0.29 | +3.1 | −21.0 |
| 23 | 0.2 | 0.20 | 0.67 | 0.49 | 1.75 | 0.28 | +3.2 | −19.5 |
| 24 | 0.3 | 0.20 | 0.67 | 0.47 | 1.72 | 0.27 | +3.0 | −16.5 |
| 25 | 0.6 | 0.19 | 0.66 | 0.45 | 1.68 | 0.27 | +3.2 | −12.8 |
| 26 | 1.0 | 0.19 | 0.66 | 0.42 | 1.65 | 0.25 | +3.1 | −9.4 |
| 27 | 2.0 | 0.19 | 0.65 | 0.40 | 1.50 | 0.27 | +3.2 | −8.6 |
| 28 | 3.0 | 0.19 | 0.65 | 0.38 | 1.48 | 0.26 | +3.2 | −7.5 |

***indicates out of the scope of the present disclosure

As is evident from the sample Nos. 21 to 28, there is hardly any difference in the inductance change rate ΔL in the thermal shock test, but as is evident from the comparison between the sample Nos. 22 to 28 and the sample No. 21, the inductance change rate ΔL in the DC superposition test was reduced and the DC superposition characteristics were improved when $SnO_2$ was contained in the ferrite material. Moreover, it was found that in the range of the $SnO_2$ content of 0.1 to 3.0 parts by weight with respect to 100 parts by weight of a main component, the DC superposition characteristics are further improved as the $SnO_2$ content increases.

That is, it was confirmed that the DC superposition characteristics are further improved when an appropriate amount of $SnO_2$ is contained in the main component.

INDUSTRIAL APPLICABILITY

Laminated coil components such as a laminated inductor, having excellent thermal shock resistance and DC superposition characteristics, can be realized without requiring a complicated process even when a material containing Ag as a main component is used for a coil conductor and the coil conductor and the magnetic body part are simultaneously fired.

With the laminated coil component, in the laminated coil component having a magnetic body part made of a ferrite material and a conductor part wound into a coil shape, where the conductor part is embedded in the magnetic body part to form a component base, because the component base is divided into a first region near the conductor part and a second region other than the first region, the grain size ratio of the average crystal grain size of the magnetic body part in the first region to the average crystal grain size of the magnetic body part in the second region is 0.9 or less (preferably 0.8 or less), the ferrite material contains at least a Cu component, and the content of the Cu component is 0.2 to 4 mol % (preferably 0.4 to 4 mol %) in terms of CuO, the grain growth in the first region during firing is suppressed compared with the second region, resulting in the reduction in sinterability, and the magnetic permeability of the first region is also lower than that of the second region.

That is, in the first region near the conductor part, since the sintered density is lowered because of a decrease in sinterability, internal stress can be mitigated, and the fluctuation of the magnetic characteristics such as inductance can be suppressed even when thermal shock or external stress is loaded due to the reflow treatment in mounting a component on a substrate or the like. Further, in the first region, because the magnetic permeability is reduced, the DC superposition characteristics are improved, and therefore concentration of a magnetic flux is largely mitigated, and the saturated magnetic flux density can be improved.

Furthermore, since the content of the Cu component is set to 0.2 to 4 mol % (more preferably 0.4 to 4 mol %) in terms of CuO as described above, the grain size ratio can be easily made 0.9 or less without impairing the grain growth in the second region even when firing is carried out in a firing atmosphere of low oxygen concentration, and it becomes possible to obtain a laminated coil component such as a laminated inductor having excellent thermal shock resistance and DC superposition characteristics while ensuring a high insulating property.

Further, in accordance with the method for manufacturing a laminated coil component of the present disclosure, since the method includes a magnetic sheet preparation step of preparing a magnetic sheet from a ferrite raw material powder containing at least a Cu oxide; a paste preparation step of preparing a conductive paste containing Ag as a main component; a coil pattern formation step of forming a coil pattern on a surface of the magnetic sheet by applying the conductive paste onto the magnetic sheet; a laminated body formation step of laminating the magnetic sheets provided with the formed coil pattern in a predetermined direction to form a laminated formed body; and a firing step of firing the laminated formed body in a firing atmosphere in which the oxygen concentration is 0.1 volume % or less (preferably 0.001 volume % or more) to prepare a component base in which an internal conductor is embedded in a magnetic body, oxygen defects are formed in a crystal lattice to promote the interdiffusion of the respective components in the ferrite raw material powder, and low-temperature sinterability can be improved, and thereby, it becomes possible to decrease the firing temperature to such an extent that the ferrite raw material can be fired simultaneously with Ag, and the grain size ratio can be made 0.9 or less. Therefore, it is possible to obtain a laminated coil component which has excellent thermal shock resistance that the changes in magnetic characteristics such as inductance are suppressed even when thermal shock or external stress is loaded, and has excellent DC superposition characteristics.

Further, when the conductor part contains Ag as a main component and the magnetic sheet to serve as a magnetic body part contains a Cu component, if the conductor part and the magnetic body part are fired simultaneously under a low oxygen concentration, the Cu component contained in the first region near the conductor part is absorbed by Ag, and thereby, the content of the Cu component in the first region is reduced to deteriorate the sinterability of the first region compared with the sinterability of the second region, and thereby, the grain size ratio can be easily decreased to 0.9 or less.

Further, it becomes possible to further improve DC superposition characteristics when the ferrite material contains a Sn component.

Further, by performing firing in a firing atmosphere in which the oxygen concentration is 0.001 to 0.1 volume %, it becomes possible to decrease the firing temperature to such an extent that the ferrite material can be fired simultaneously with Ag even when the content of CuO is reduced to 4 mol % or less, and therefore it becomes possible to prepare a component base in which the conductor part is embedded in the magnetic body part without impairing specific resistance.

When firing is performed in a firing atmosphere in which the oxygen concentration is 0.1 volume % or less, oxygen defects are produced in a crystal lattice to promote the interdiffusion of the respective components in the ferrite raw material powder, and low-temperature sinterability can be improved, and thereby, it becomes possible to decrease the firing temperature to such an extent that the ferrite raw material can be fired simultaneously with Ag, and the above-mentioned grain size ratio can be made 0.9 or less.

That which is claimed is:

1. A laminated coil component comprising:

a magnetic body part made of a ferrite material; and a conductor part wound into a coil shape, the conductor part being embedded in the magnetic body part to form a component base, wherein the component base is divided into a first region near the conductor part and a second region other than the first region, the grain size ratio of the average crystal grain size of the magnetic body part in the first region to the average crystal grain size of the magnetic body part in the second region is 0.9 or less, the ferrite material contains at least a Cu component, the content of the Cu component is 0.2 to 4 mol % in terms of CuO, and the first and second regions of the component base are magnetic.

2. The laminated coil component according to claim 1, wherein the grain size ratio is 0.8 or less.

3. The laminated coil component according to claim 1, wherein the content of the Cu component is 0.4 to 4 mol % in terms of CuO.

4. The laminated coil component according to claim 1, wherein the conductor part contains Ag as a main component.

5. The laminated coil component according to claim 1, wherein the ferrite material contains a Sn component.

6. The laminated coil component according to claim 5, wherein said Sn component is 0.1 to 3.0 parts by weight in terms of $SnO_2$ with respect to 100 parts by weight of a main component.

7. The laminated coil component according to claim 1, wherein the component base is formed by being sintered in a firing atmosphere in which the oxygen concentration is 0.001 to 0.1 volume %.

8. The laminated coil component according to claim 1, wherein the component base further comprises a non-magnetic sheet provided across the conductor part and having a major surface perpendicular to an axial direction of the coil shape.

9. The laminated coil component according to claim 1, wherein the second region substantially surrounds the first region.

10. The laminated coil component according to claim 1, wherein the second region extends substantially through a core of the conductor part.

* * * * *